US006781330B1

(12) United States Patent
Koenck et al.

(10) Patent No.: US 6,781,330 B1
(45) Date of Patent: Aug. 24, 2004

(54) DIRECT INJECTION ACCELERATOR METHOD AND SYSTEM

(75) Inventors: Steven E. Koenck, Cedar Rapids, IA (US); Stan V. Lyons, Brentwood, CA (US); Paul Treas, Livermore, CA (US)

(73) Assignee: Mitec Incorporated, Cedar Rapids, IA (US)

( * ) Notice: Subject to any disclaimer, the term of this patent is extended or adjusted under 35 U.S.C. 154(b) by 40 days.

(21) Appl. No.: 10/198,565

(22) Filed: Jul. 18, 2002

Related U.S. Application Data

(63) Continuation-in-part of application No. 09/789,313, filed on Feb. 20, 2001, now Pat. No. 6,429,608.

(60) Provisional application No. 60/183,613, filed on Feb. 18, 2000.

(51) Int. Cl.[7] ..... H05H 9/00

(52) U.S. Cl. ..... 315/500; 315/5.42; 315/505; 250/492.3

(58) Field of Search ..... 315/500, 501, 315/5.42, 5.41; 250/492.3, 493.1

(56) References Cited

U.S. PATENT DOCUMENTS

| | | | | |
|---|---|---|---|---|
| 924,284 | A | 6/1909 | Smith | |
| 1,809,078 | A | 6/1931 | Smith | |
| 2,095,502 | A | 10/1937 | Johnston | 21/54 |
| 2,456,909 | A | 12/1948 | Brasch | 21/54 |
| 2,602,751 | A | 7/1952 | Robinson | 99/221 |
| 2,741,704 | A | 4/1956 | Trump et al. | 250/49.5 |
| 2,816,231 | A | 12/1957 | Nygard | 250/43 |
| 2,824,969 | A | 2/1958 | Crowley-Milling | 250/49.5 |
| 2,963,369 | A | 12/1960 | Urbain | 99/107 |
| 2,989,735 | A | 6/1961 | Gumpertz | 340/174.1 |
| 3,087,598 | A | 4/1963 | Clore | 198/38 |
| 3,224,562 | A | 12/1965 | Bailey et al. | 198/131 |
| 3,261,140 | A | 7/1966 | Long et al. | 53/22 |
| 3,396,273 | A | 8/1968 | Brunner | 250/52 |
| 3,452,195 | A | 6/1969 | Brunner | 250/52 |
| 3,560,745 | A | 2/1971 | Petersen et al. | 250/83 |
| 3,564,241 | A | 2/1971 | Ludwig | 250/52 |
| 3,567,462 | A | 3/1971 | Silverman et al. | 99/157 |
| 3,676,673 | A | 7/1972 | Coleman | 250/49.5 |
| 3,676,675 | A | 7/1972 | Ransohoff et al. | 250/52 |
| 3,876,373 | A | 4/1975 | Glyptis | 21/54 |
| 3,965,434 | A | 6/1976 | Helgesson | 328/233 |
| 3,974,391 | A | 8/1976 | Offermann | 250/492 |
| 4,013,261 | A | 3/1977 | Steigerwald et al. | 250/453 |
| 4,066,907 | A | 1/1978 | Tetzlaff | 250/453 |
| 4,151,419 | A | 4/1979 | Morris et al. | 250/453 |
| 4,201,920 | A | 5/1980 | Tronc et al. | 250/492 |
| 4,281,251 | A | 7/1981 | Thompson et al. | 250/398 |
| 4,484,341 | A | 11/1984 | Luniewski | 378/69 |
| 4,652,763 | A | 3/1987 | Nablo | 250/492.3 |
| 4,663,532 | A | 5/1987 | Roche | 250/400 |
| 4,757,201 | A | 7/1988 | Kanter | 250/337 |
| 4,760,264 | A | 7/1988 | Barrett | 250/453.1 |

(List continued on next page.)

*Primary Examiner*—David Vu
(74) *Attorney, Agent, or Firm*—Kinney & Lange, P.A.

(57) ABSTRACT

An electron beam accelerator system includes a high voltage supply circuit having a high voltage output. A cathode structure is coupled to the high voltage supply circuit at the high voltage output. An anode structure is spaced from the cathode structure and has a voltage associated therewith such that a voltage difference exists between the cathode structure and the anode structure. This voltage difference creates an electron beam flowing between the cathode structure and the anode structure. An electron beam output is adjacent to the anode structure. A control grid is located between the cathode structure and the anode structure and receives a time-varying voltage. This time-varying voltage prevents ringing of the high voltage output, reducing the risk of dielectric breakdown and failure due to transient high voltages.

22 Claims, 7 Drawing Sheets

U.S. PATENT DOCUMENTS 4,767,930 A 8/1988 Stieber et al. ..... 250/396
4,785,178 A 11/1988 Lynch et al. ..... 250/496.1
4,788,701 A 11/1988 Barrett ..... 378/69
4,852,138 A 7/1989 Bergeret et al. ..... 378/69
4,864,595 A 9/1989 Barrett ..... 378/69
4,866,281 A 9/1989 Bosshard ..... 250/453.1
4,870,368 A 9/1989 Putnam ..... 328/233
4,908,221 A 3/1990 Barrett ..... 426/240
4,974,503 A 12/1990 Koch ..... 99/451
4,999,496 A * 3/1991 Shaw et al. ..... 250/310
5,004,926 A 4/1991 Vassenaix et al. ..... 250/492.3
5,008,550 A 4/1991 Barrett ..... 250/453.1
5,026,983 A 6/1991 Meyn ..... 250/233 R
5,096,553 A 3/1992 Ross et al. ..... 204/157.15
5,101,168 A 3/1992 Miller ..... 328/233
5,323,442 A 6/1994 Golovanivsky et al. ..... 378/119
5,362,442 A 11/1994 Kent ..... 422/22
5,366,746 A 11/1994 Mendenhall ..... 426/521
5,396,071 A 3/1995 Atwell et al. ..... 250/358.1
5,396,074 A 3/1995 Peck et al. ..... 250/453.11
5,400,382 A 3/1995 Welt et al. ..... 378/69
5,434,421 A 7/1995 Burth ..... 250/434
5,451,790 A 9/1995 Enge ..... 250/436
5,461,656 A 10/1995 Golovanivsky et al. ..... 378/66
5,470,597 A 11/1995 Mendenhall ..... 426/521
5,482,726 A 1/1996 Robinson, Jr. ..... 426/238
5,530,255 A 6/1996 Lyons et al. ..... 250/492.3
5,554,856 A 9/1996 Bidnyy et al. ..... 250/455
5,557,109 A 9/1996 Bidnyy et al. ..... 250/455
5,590,602 A 1/1997 Peck et al. ..... 104/88.01
5,593,713 A 1/1997 De La Luz-Martinez et al. ..... 426/237
5,597,597 A 1/1997 Newman ..... 426/248
5,603,972 A 2/1997 McFarland ..... 426/240
5,635,714 A 6/1997 Nablo et al. ..... 250/305
5,661,305 A 8/1997 Lawrence et al. ..... 250/397
5,690,978 A 11/1997 Yin et al. ..... 426/237
5,801,387 A 9/1998 Nablo et al. ..... 250/492.3
5,834,744 A 11/1998 Risman ..... 219/697
5,838,760 A 11/1998 Moses ..... 378/119
5,847,401 A 12/1998 McKeown et al. ..... 250/396
5,881,534 A 3/1999 Ahlqvist et al. ..... 53/403
5,994,706 A 11/1999 Allen et al. ..... 250/454.11
6,023,497 A 2/2000 Takahashi et al. ..... 378/57
6,027,754 A 2/2000 Bushnell et al. ..... 426/238
6,051,185 A 4/2000 Beers ..... 422/22
6,066,348 A 5/2000 Yuan et al. ..... 426/236
6,086,932 A 7/2000 Gupta ..... 426/237
6,096,379 A 8/2000 Eckhoff ..... 427/428
6,127,687 A 10/2000 Williams et al. ..... 250/492.3
6,429,444 B1 8/2002 Korenev et al. ..... 250/492.3

* cited by examiner

DIRECT INJECTION ACCELERATOR METHOD AND SYSTEM

CROSS-REFERENCE TO RELATED APPLICATION(S)

This application is a Continuation-In-Part of application Ser. No. 09/789,313 filed Feb. 20, 2001 for "Direct Injection Accelerator Method and System" by S. Lyons, P. Treas and S. Koenck, now U.S. Pat. No. 6,429,608 which in turn claims the benefit of Provisional Application No. 60/183,613 filed Feb. 18, 2000 for "Direct Injection Accelerator Method and System" by S. Lyons, P. Treas and S. Koenck.

INCORPORATION BY REFERENCE

The aforementioned application Ser. No. 09/789,313 and Provisional Application No. 60/183,613 are hereby incorporated by reference in their entirety.

BACKGROUND OF THE INVENTION

The present invention relates to an electron beam accelerator, and more particularly to a system for dynamically controlling a cathode current flowing in the accelerator to reduce overshoot in the output voltage of the step-up transformer employed by the accelerator.

Particle acceleration technology has been known and used for a variety of applications for many years. Much of the technology was developed in the 1950's and 1960's for scientific research in the study of matter and its subatomic composition. In subsequent years, industrial applications of particle accelerators, particularly electron beam accelerators, have been identified. Such applications include curing of resins used in the manufacture of composite materials, cross-linking polymers and irradiation of food to eliminate harmful parasites and pathogens.

The energy of a moving electron is given in units of electron volts (eV) which correspond to the velocity that an electron would achieve if it were attracted to a positive static voltage V. The typical electron energies for food irradiation purposes range from 1 to 10 million electron volts (MeV). Higher energy electrons are able to penetrate to greater depths, but typically require more complex and costly equipment to generate. Penetration to greater depths has the advantage of allowing irradiation processing of thicker materials, but has the disadvantage of requiring greater shielding to reduce the radiation exposure of operating personnel to safe levels.

The typical technology used to accelerate electrons to the 1 to 10 MeV energy range involves the use of a very high power microwave pulse driving a precisely tuned microwave waveguide. The construction of the waveguide and the generation of the very high power microwave pulse are complex and involve processes that are consequently rather costly. For relatively low electron energies of up to several hundred KeV, a static direct current voltage source is typically used. A very common application of this method is x-ray generation which is commonly used for medical and industrial imaging. However, energies of 1 to 10 MeV would require the generation of a static voltage of 1 to 10 megavolts (MV). Such high voltages are quite difficult to manage without dielectric breakdown and resultant failure. A system that provides a sufficiently high voltage to achieve electron energies of greater than about 1 MeV while reducing or eliminating the risk of dielectric breakdown would be an improvement to the state of the art.

In addition to this, typical electron beam accelerators are constrained to operate at predetermined fixed energy levels.

Certain irradiation applications would benefit from a capability to generate electrons at variable energy levels depending on certain physical characteristics of the material to be processed. For example, de-infesting of grain may require relatively shallow electron beam penetration to kill parasites or pathogens while preserving the germination potential of the seed. Different types of seeds may need different electron beam energy to effectively de-infest the seeds. A variable energy accelerator would make it possible to process these or other materials that need variable penetration and exposure.

BRIEF SUMMARY OF THE INVENTION

The present invention is a direct injection electron beam accelerator system that includes a direct current voltage source and a pulse forming network coupled through a resistor to the direct current voltage source. A high power switching device is coupled between the direct current voltage source and the pulse forming network. A pulse control circuit is connected to control the high power switching device to selectively allow a current to flow to the pulse forming network. A step-up transformer is coupled to the pulse forming network, and a cathode structure is coupled to the high voltage output of the step-up transformer. An anode structure is spaced from the cathode structure, and has a first voltage associated therewith such that a voltage difference exists between the cathode structure and the anode structure. This voltage difference creates an electron beam flowing between the cathode structure and the anode structure. An electron beam output is adjacent to the anode structure. A control grid is located between the cathode structure and the anode structure. A control grid drive circuit is operatively coupled to the pulse control circuit and the control grid, and is operable to apply a time-varying second voltage to the control grid synchronized with the pulse control circuit. The control grid therefore effectively provides a dynamic load on the high voltage output of the step-up transformer that prevents overshoot in the transformer output, reducing the risk of dielectric breakdown and failure due to transient high voltages.

DETAILED DESCRIPTION

The concept of the present invention is to generate and control a high voltage pulse of sufficient magnitude to be usable for acceleration of electrons to the energies required for industrial irradiation applications and for a time duration and duty cycle sufficient to generate the required average output power. This invention may potentially be applied to voltages over the entire range of 1 to 10 megavolts, but is primarily described below in the context of an exemplary embodiment where the accelerating voltage is in the 1 to 2 megavolt (MV) range.

Figure 1:
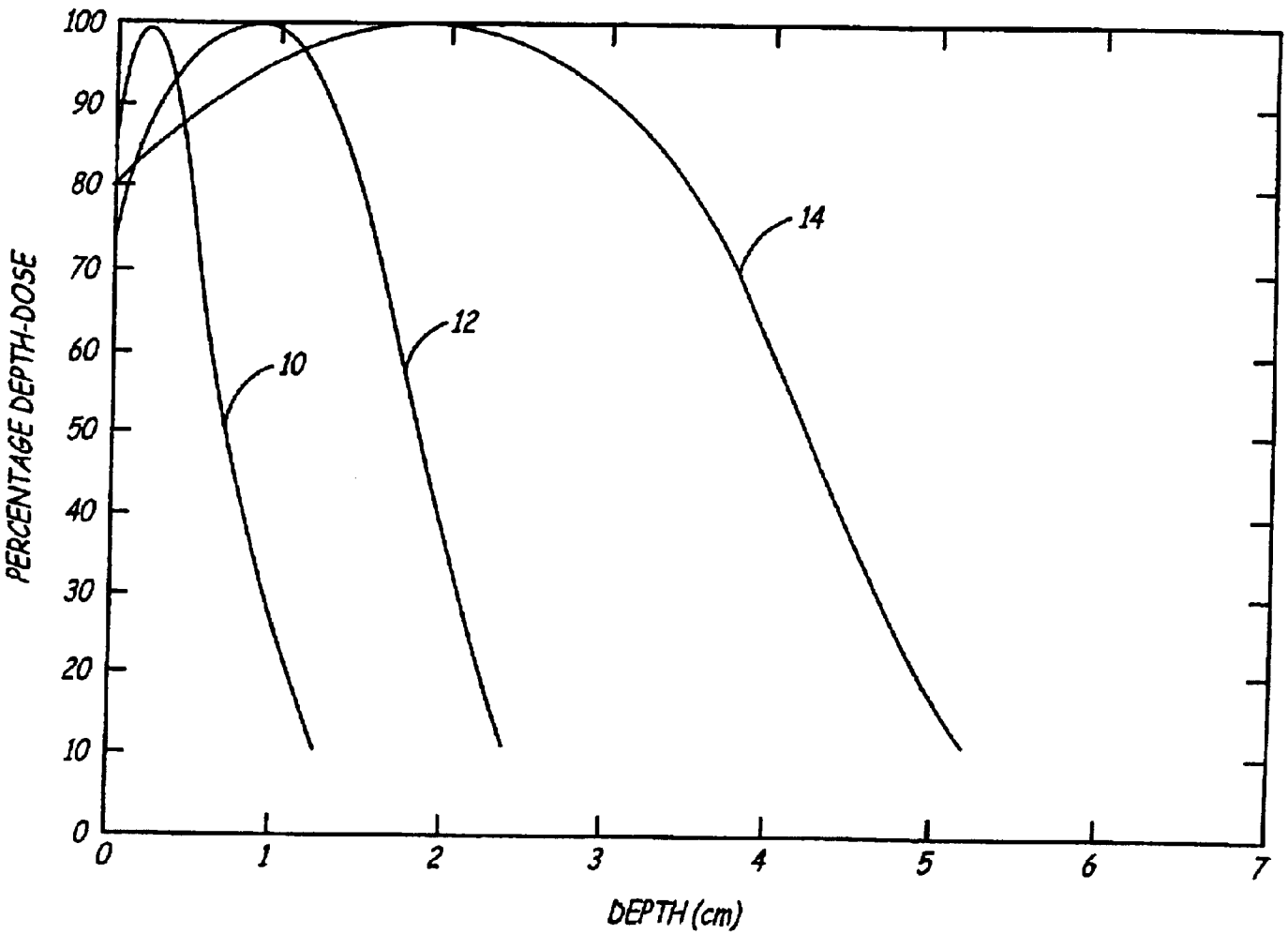
FIG. 1 is a graph showing percentage depth-dose curves for electron irradiation of water by electrons with different energy levels.

FIG. 1 is a graph showing percentage depth-dose curves for electron irradiation of water by electrons with different energy levels. Curve 10 shows the percentage depth-dose curve in water for 1.8 MeV electrons. Curve 12 shows the percentage depth-dose curve in water for 4.7 MeV electrons. Curve 14 shows the percentage depth-dose curve in water for 10.6 MeV electrons. Curves 10, 12 and 14 illustrate the greater penetration depth achieved by higher energy electrons, which allows irradiation processing of thicker materials. Energy levels above about 1 MeV are typically sufficient for effective food irradiation. In order to accelerate electrons to such high energy levels, voltages above about 1 MV are required. The present invention, as described below, provides an electron beam accelerator system that produces such high voltages with reduced instability and risk of failure.

Figure 2:
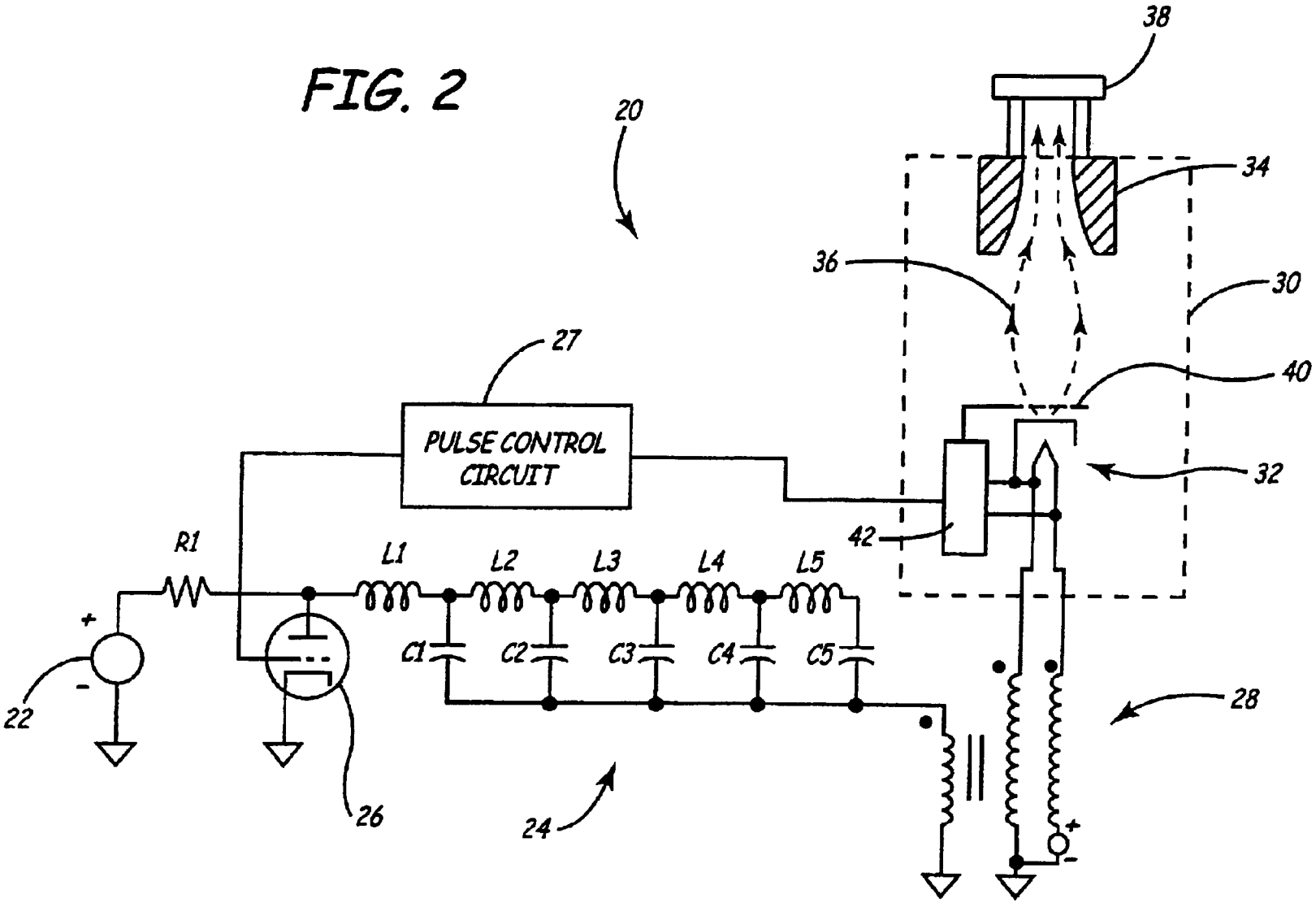
FIG. 2 is a schematic diagram illustrating one embodiment of the electron beam accelerator system of the present invention.

FIG. 2 is a schematic diagram illustrating electron beam accelerator system 20 according to the present invention. DC voltage source 22, supplying 50 kV in an exemplary embodiment, is connected through resistor R1 to charge lumped parameter inductive pulse forming network 24. In the exemplary embodiment shown in FIG. 2, pulse forming network includes inductors L1, L2, L3, LA and L5 and capacitors C1, C2, C3, C4 and C5. Thyratron 26, or another type of high voltage, high power device, switches the input of the RC pulse forming network 24 to ground under the control of pulse control circuit 27, which results in a current flow through the primary circuit of high voltage step-up transformer 28 in a series of time delayed pulse shaped steps. In an exemplary embodiment, the transformer turns ratio is 82:1 to generate a nominal output voltage of 2 MV, taking into consideration the voltage division effect on the primary side of transformer 28. The entire structure of transformer 28 is preferably placed within a dielectric oil-filled environment to prevent dielectric breakdown and arc discharge of high voltage to surrounding conductive surfaces. The winding polarity of transformer 28 is oriented to generate a high negative voltage output pulse which is connected to electron accelerator assembly 30 operating in a high vacuum environment, and more specifically to cathode structure 32 of electron accelerator assembly 30. This high negative voltage pulse causes a transient voltage differential between cathode structure 32 and anode structure 34 which is held to near ground potential. Electrons consequently move through the high vacuum environment in electron beam path 36 and out of output flange 38 at a velocity corresponding to the voltage differential between cathode structure 32 and anode structure 34.

Reliable generation and control of high voltage pulses in the 1 to 2 MV range with a simple voltage step-up circuit is typically not feasible because the output impedance of transformer 28 is uncontrolled and not matched to the primary circuit, which results in output voltage ringing and resultant dielectric breakdown failure. The present invention solves this problem by employing control grid 40, under the control of control grid drive circuit 42, in the cathode circuit of the pulsed accelerator shown in FIG. 2. Control grid 40 operates to effectively place a dynamic load on the output of transformer 28 to prevent ringing in the output voltage of transformer 28, which reduces the risk of dielectric breakdown due to high overshoot voltages. Control grid 40 is driven by control grid drive circuit 42 such that a voltage applied on control grid 40 relative to the voltage of cathode structure 32 controls the flow of electrons in a manner similar to a typical triode vacuum tube. A voltage on control grid 40 of approximately −300 volts, for example, would hold the current through cathode structure 32 off, while an increasingly positive control voltage of up to approximately +100 volts would cause cathode current to flow in relation to the control voltage. This ability to control current flow causes an effect equivalent to controlling circuit impedance when the current flow is related to the applied voltage.

Figure 3A:
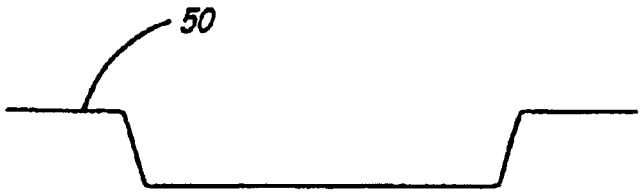
FIGS. 3A–3E are graphs of waveforms illustrating the operation of a problematic prior art electron beam accelerator system configuration and the improvements achieved by the present invention.
Figure 3B:
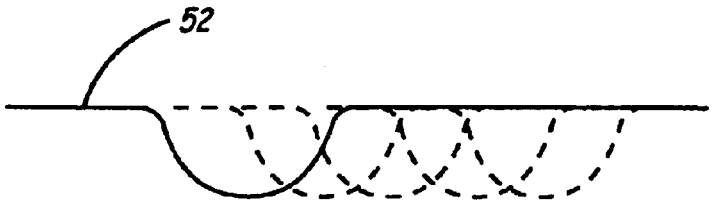
Figure 3C:
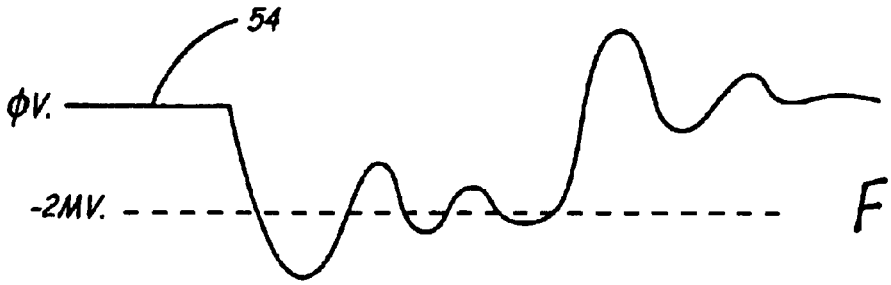
Figure 3D:
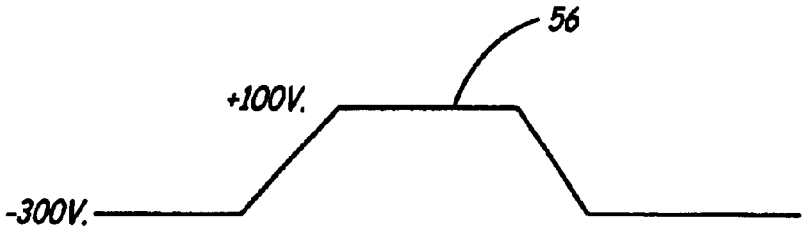
Figure 3E:
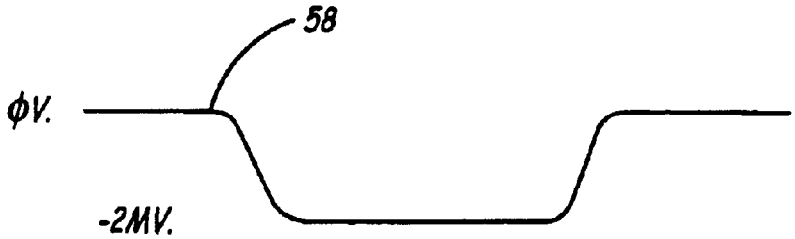

FIGS. 3A–3E are graphs of waveforms illustrating the operation of a problematic prior art electron beam accelerator system configuration and the improvements achieved by the present invention. FIG. 3A shows in curve 50 the current that flows through thyratron switch 26 (FIG. 2) which drives pulse forming network 24 (FIG. 2). The charge stored in capacitors C1, C2, C3, C4 and C5 of pulse forming network 24 causes current to flow through the primary circuit of high voltage step-up transformer 28 (FIG. 2). If there were a single capacitor driving step-up transformer 28, there would be only a single pulse of output voltage out of transformer 28. By placing a series of capacitors C1, C2, C3, C4 and C5 and inductors L1, L2, L3, L4 and L5 in the primary circuit, the charge stored on the capacitors causes current to flow in both the transformer primary and the series of inductors, which result in a set of superimposed pulses as shown by curve 52 and similarly shaped time-delayed phantom curves in FIG.3B that add in sequence to form a composite relatively long, flat drive pulse. The superposition of the primary drive pulses from pulse forming network 24 causes a similar superposition of output voltage which would ideally have the shape of a conventional square wave pulse. If the output of transformer 28 is not electrically loaded, however, there will be output voltage ringing and overshoot as illustrated by curve 54 in FIG. 3C. If the desired output voltage is a negative 2 MV, and that is the maximum system voltage that may be sustained without dielectric breakdown, the unloaded output voltage overshoot could result in failure. FIG. 3D shows an exemplary timed control grid voltage provided by control grid drive circuit 42 (FIG. 2) that causes a cathode current to flow while the output voltage of step-up transformer 28 begins to build up, thereby effectively placing a load on the output of transformer 28 to prevent the output voltage overshoot. This timed control grid voltage waveform is triggered by pulse control circuit 27 (FIG. 2), and is produced through digital means, using feed-forward techniques to control the cathode current waveform very carefully. Although a simple waveform is shown in FIG. 3D, it should be appreciated by those skilled in the art that a more complex control grid voltage waveform may be provided by control grid drive circuit 42 to achieve additional damping of output voltage overshoot. As a result of the utilization of control grid 40, an output voltage pulse is obtained as shown by curve 58 in FIG. 3E that reaches the maximum voltage with minimal overshoot and sustains that voltage for a time corresponding to the energy stored in capacitors C1, C2, C3, C4 and C5 of pulse forming network 24. The voltage difference between cathode structure 32 and anode structure 34 (FIG. 2) which is held at ground potential is equal to the voltage as shown in FIG. 3E. While there will be a small transient time when the voltage difference is changing between ground and 2 MV, the majority of the pulse time is spent at the target 2 MV voltage. Electrons that are emitted from heated cathode structure 32 and passed through control grid 40 are accelerated by the cathode-anode voltage differential and move toward anode structure 34, ultimately reaching a velocity of 2 MeV at the anode. To prevent the electrons from actually reaching the anode, a focusing magnet is preferably placed to exert a force on the electrons that causes electron beam 36 (FIG. 2) to be condensed, focused and passed through an exit port in anode structure 34 and through output flange 38, as will be explained in more detail below.

Figure 4:
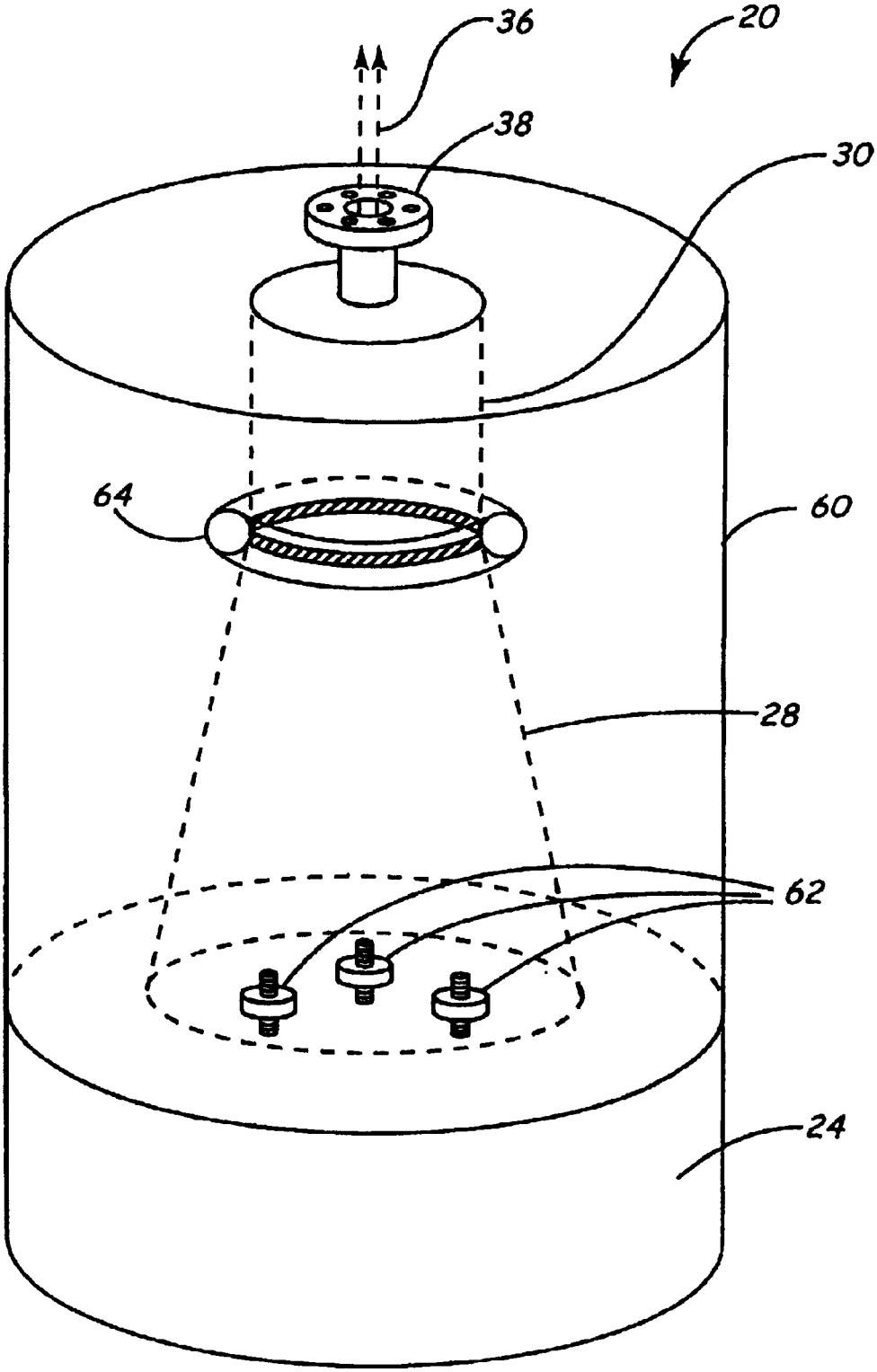
FIG. 4 is a diagram showing an exemplary embodiment of the electron beam accelerator system of the present invention housed in a dielectric oil-filled vessel.

FIG. 4 is a diagram showing an exemplary embodiment of electron beam accelerator system 20 of the present invention, including dielectric oil-filled vessel 60 completely surrounding high voltage step-up transformer 28 and accelerator assembly 30. Vessel 60 may be constructed of metal such as stainless steel and may be generally cylindrical in shape. The size of vessel 60 may be on the order of 42 inches in diameter and 36 inches tall in an exemplary embodiment to provide sufficient dielectric distance between the structure of transformer 28 and the grounded vessel walls. Dielectric oil may typically maintain a standoff voltage under pulsed conditions of 100 kV per inch, so a typical distance of 24 inches between the highest voltage points of the transformer/accelerator and the vessel walls is able to sustain a peak voltage of about 2 MV. Pulse forming network 24 and other circuitry may be located below the vessel in an exemplary embodiment, and connected to high voltage step-up transformer 28 through access ports 62. Toroidal field shaper 64 or another high field strength management geometric shape may be placed at the interface between accelerator 30 and transformer 28 (adjacent to cathode assembly 32 (FIG. 2)) to reduce dielectric breakdown near the otherwise sharp or pointed shapes associated with cathode structure 32. Output flange 38 located at the top of the assembly is a typical high vacuum mechanical structure that may be physically bolted to electron beam management facilities such as beam current monitors, quadrupole magnets or scanning magnets that direct the beam toward application targets.

Figure 5:
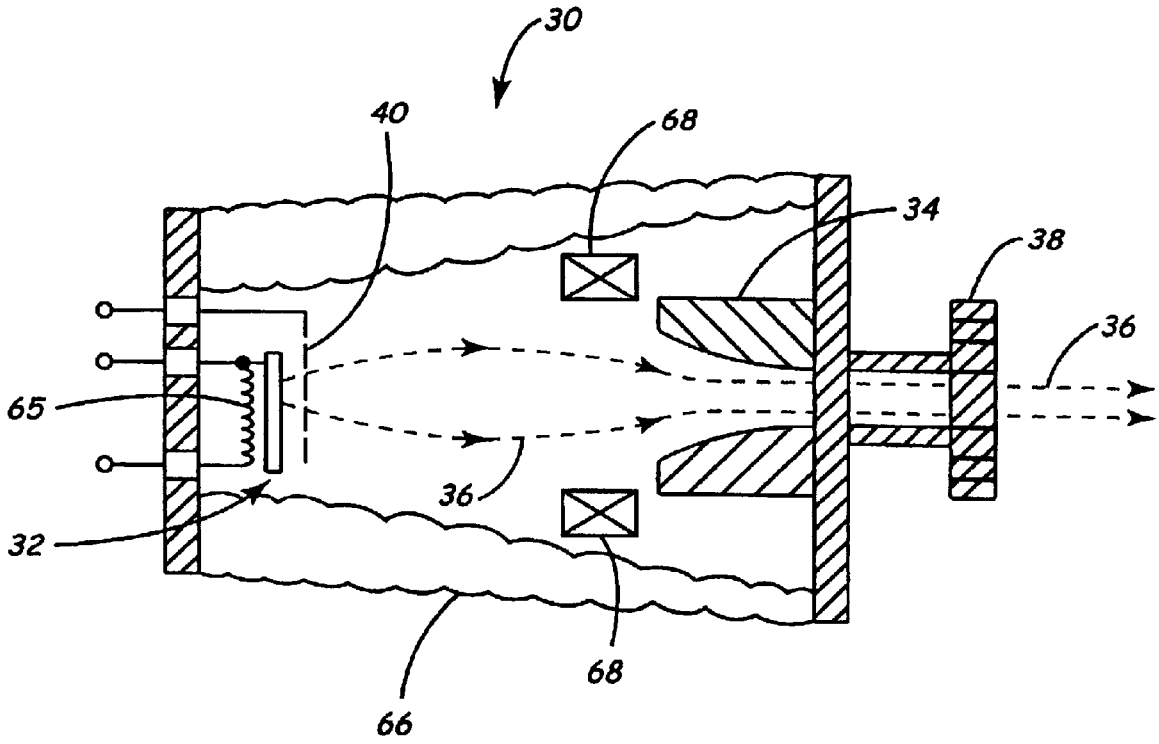
FIG. 5 is a diagram showing the electron beam accelerator module of the accelerator system in more detail.

FIG. 5 is a diagram showing electron beam accelerator 30 in more detail. The basic operation of accelerator 30 is as a triode vacuum tube with a very high voltage pulsed cathode drive. Filament 65 is driven by a bifilar secondary winding of step-up transformer 28 (FIG. 2). The bifilar secondary windings are driven differentially by a relatively low voltage DC power supply, as shown in FIG. 2. This DC voltage will be present as a differential voltage, along the entire length of the secondary windings, and on to the output which provides heater current to filament 65 and provides operating voltage to control grid drive circuit 42, shown schematically in FIG. 2. In an exemplary embodiment, control grid drive circuit 42 is controlled by a fiber optic control signal to provide the necessary voltage isolation. The entire cathode assembly 32 is driven to the voltage of the output transformer as shown in FIG. 3E, so electrical isolation of the entire assembly is required. A long, tapered ceramic envelope 66 is welded or brazed to the plate of cathode structure 32 to provide the mechanical structure with electrical insulation. The length of envelope 66 must be sufficient to hold off the maximum voltage difference present between cathode 32 and anode 34. By fabricating envelope 66 with a corrugated or convoluted exterior shape, the electrical length of envelope 66 may be extended while maintaining a shorter overall physical length. The interior of accelerator 30 contains anode structure 34 and focusing magnet 68, the combination of which forms electron path 36 that generally moves toward anode 34 and squeezes the electrons into a small cylindrical beam shape to be directed through the center of anode structure 34 and on through output flange 38.

The voltage waveform that accelerates electrons in direct injection accelerator 30 moves from near zero voltage difference to 2 MV difference in a finite amount of time. While this time is small, there will be some electrons emitted from the accelerator that are not at the target energy for the irradiation application. Several observations may be made about these electrons. First, their energy is always less than 2 MeV, so there is no concern that higher energies and resultant greater shield penetration will exist. Second, since their energy is lower, there will be an increased exposure of the target materials closer to the entry point. This may be generally seen in FIG. 1 where lower electron beam energy causes increased exposure closer to the entry depth. It is also seen in FIG. 1 that the relative exposure at the entry depth is on the order of 80% of the maximum exposure, so not only is there little concern for overexposing the material closest to the entry depth, but in fact, the presence of some amount of lower energy electrons may result in more consistent exposure near the entry point. Third, the actual amount of beam power present in these lower energy electrons is expected to be less than 5% of the total power due simply to the short time that the voltage transition is occurring relative to the total length of the acceleration pulse.

Figure 6:
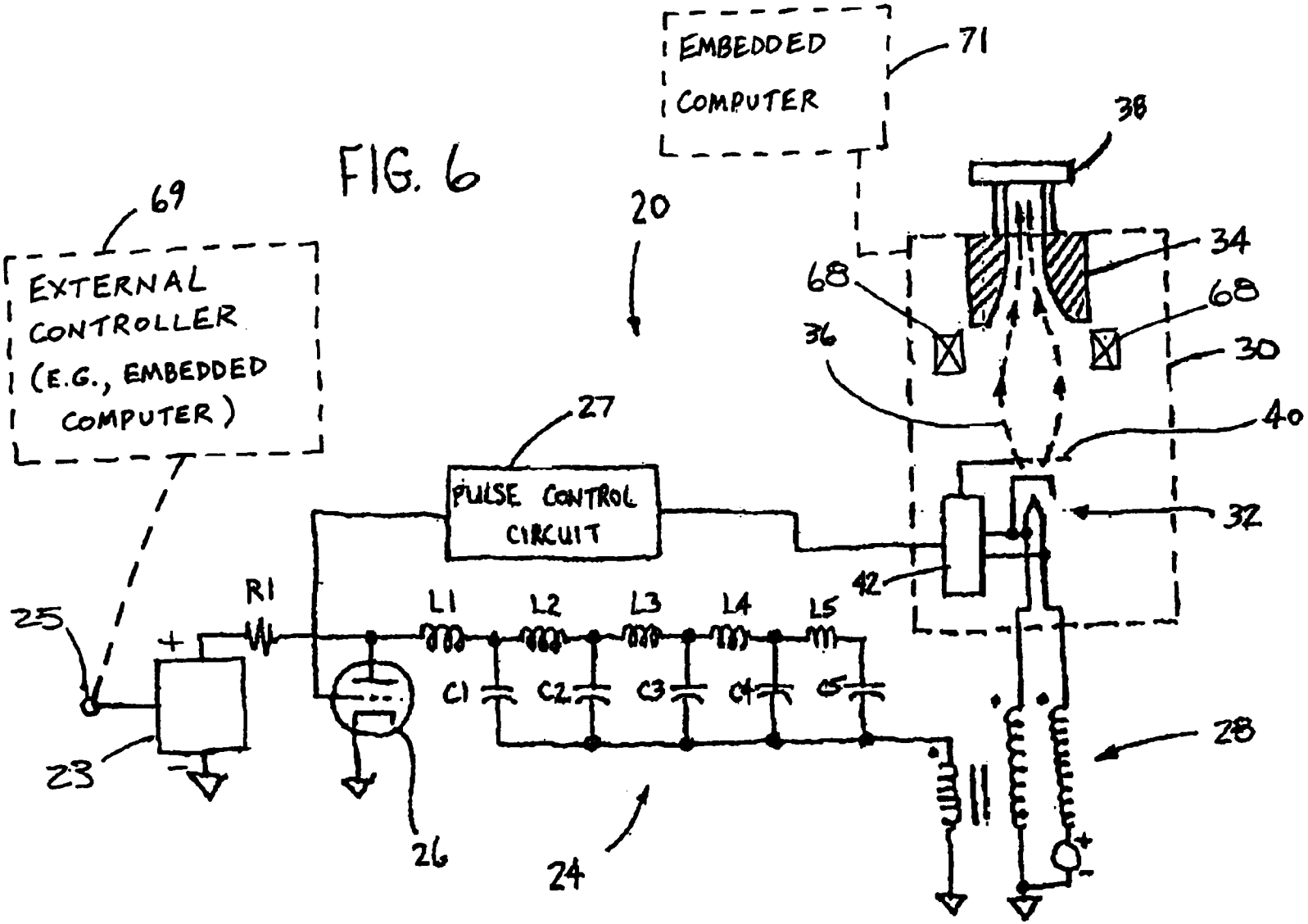
FIG. 6 is a diagram illustrating an exemplary embodiment of an electron beam accelerator capable of accelerating electrons to selected variable energy levels according to the present invention.

FIG. 6 is a schematic diagram illustrating an exemplary embodiment of an electron beam accelerator capable of accelerating electrons to selected variable energy levels according to the present invention. Similar to the schematic diagram of FIG. 2, the configuration of FIG. 6 is capable of accelerating electrons to energy levels in the 1 to 2 MeV range. The accelerator system of FIG. 6, however, has a variable voltage source 23 coupled through resistor R1 to charge the lumped parameter pulse forming network. An important criterion for variable energy operation is for the energy to be quickly and easily changed by a simple electronic control system rather than some complex physical or mechanical structure. In an exemplary embodiment, the variable voltage source 23 may be controlled by an external controller 69 such as an embedded computer coupled to an input 25 of the variable voltage, source 23. The maximum voltage output by the variable voltage source 23 may be the same as the fixed output voltage of the voltage source 22 of FIG. 2, which establishes the maximum energy electrons that may be generated by the system. This parameter along with the power capacity of the accelerator determines the shielding requirements for the system, since any lower energy operating mode that may be selected by the embedded controller will generate accelerated electrons that have less penetration capability than the maximum.

The stream of accelerated electrons 36 output from the cathode structure 40 with its high negative voltage potential is directed toward the anode structure 34 that is held near ground (zero volts) electrical potential. Focusing magnets 68 are placed surrounding the electron stream 36 emitted from the cathode structure to squeeze the electron stream 36 into a tight pattern that can be directed through an exit aperture interior to a coupling tube and flange 38. The strength of the magnetic field generated by the focusing magnet 68 is a function of the energy of the electron stream 36. A fixed energy accelerator such as is shown in FIG. 2 may operate with a fixed field strength focusing magnet. The variable energy accelerator of FIG. 6 generates electrons that may vary in energy from virtually zero to a maximum energy (which may be equal to the fixed energy generated by the accelerator of FIG. 2). This variable energy electron stream 36 must be focused with a focus magnet whose field strength is appropriately matched to the electron energy to create the desired consistently formed exit beam.

Figure 7:
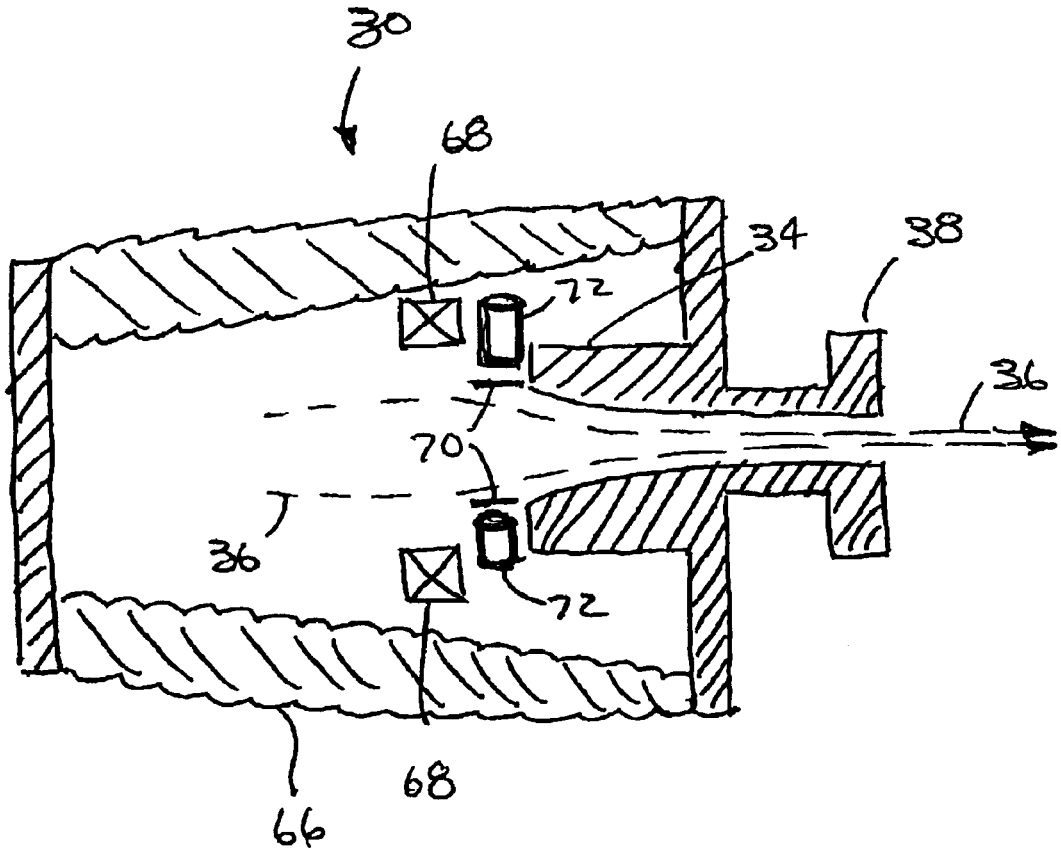
FIG. 7 is a diagram showing an exemplary embodiment of the electron beam accelerator system of the present invention having electron sensing structures.

In an exemplary embodiment, the field strength of the focus magnet is controlled by an embedded computer 71 coupled to a variable current source (not shown). The embedded computer may be the same controller that drives the variable voltage source and therefore has information relating to the necessary focus magnet field strength to shape the electron stream 36 appropriately; that is, embedded computer 71 may be the same device as external controller 69. In an alternate embodiment as shown in FIG. 7, electron sensing structures such as "sugar scoops" 70 may be located near the anode structure 34 and may be externally connected to signal processing circuits (not shown) to analyze the focus characteristics of the electron stream 36 and input this information to the embedded computer. The amount of beam current captured by the sensing structures 70 may indicate that the stream is not properly shaped into the desired cylindrical shape to be used by the radiation application apparatus. If this condition is detected, the embedded computer may increase the drive to the focus magnet in a closed-loop feedback mode to adaptively form the electron stream 36.

In a similar manner, it is possible that the centerline of the electron stream 36 is not located exactly along the centerline of the exit path through the output flange 38. The "sugar scoop" sensors 70 that identify the previously described misfocus condition may also detect this condition. Electron stream location bias will be evidenced as a differential voltage present between opposing sensor plates, which may be processed and input into the embedded computer. Additional magnet pole pairs 72 may be placed behind the focusing magnet 68 and may be driven by variable current sources coupled to the embedded computer to precisely position the location of the electron stream 36. At least two such magnet pairs are needed to locate the beam in the x and y directions. In all cases, the focusing and positioning magnets are located near the anode structure 34 and are nominally at ground potential, which minimizes arcing effects.

The present invention provides a direct injection electron beam accelerator system that is able to achieve high voltage levels required to accelerate electrons to high energy levels while reducing or eliminating the risk of dielectric breakdown. This is achieved by introducing a control grid between the cathode structure and the anode structure of the accelerator system. A time-varying voltage is applied to the control grid that causes a cathode current to flow while the output of the step-up transformer that is coupled to the cathode structure is building up, effectively placing a dynamic load on the transformer output that prevents overshoot in the transformer output signal. By preventing overshoot, transient high voltages that might exceed the dielectric capability of the accelerator system are prevented.

In addition to this, an alternate embodiment of the present invention provides a direct injection electron beam accelerator system that is capable of accelerating electrons to selected variable energy levels. This is achieved by charging a pulse forming network with a variable voltage source which may be externally controlled for quick and easy energy control. The resulting variable energy electron stream can be shaped and positioned by first analyzing the current focus characteristics and position of the electron stream using electron sensing structures, and then using focusing and positioning magnets to adjust the electron stream to the desired form and position.

It should also be understood that the present invention has applicability to x-ray irradiation systems, which employ a conversion apparatus that receives the electron beam output of the accelerator and converts the electron beam to x-ray irradiation.

Although the present invention has been described with reference to preferred embodiments, workers skilled in the art will recognize that change may be made in form and detail without departing from the spirit and scope of the invention.

What is claimed is:

1. An electron beam accelerator system comprising:

a high voltage supply circuit having a high voltage output;

a cathode structure coupled to the high voltage supply circuit at the high voltage output;

an anode structure spaced from the cathode structure, the anode structure having a voltage difference from the cathode structure, the voltage difference creating an electron beam flowing between the cathode structure and the anode structure to an electron beam output; and a control grid between the cathode structure and the anode structure that receives a time-varying voltage to prevent ringing of the high voltage output.

2. The electron beam accelerator system of claim 1, wherein the high voltage supply circuit is a variable voltage source that is controllable to alter an energy level of the electron beam.

3. The electron beam accelerator system of claim 2, further comprising:

an external controller coupled to control the variable voltage source.

4. The electron beam accelerator system of claim 1, further comprising:

a focusing magnet located between the control grid and the anode structure adjacent to the electron beam.

5. The electron beam accelerator system of claim 4, further comprising:

an electron sensing structure adjacent to the electron beam to provide a signal representing a focus characteristic of the electron beam for adjusting operation of the focusing magnet.

6. The electron beam accelerator system of claim 5, wherein the electron sensing structure comprises a sugar scoop sensor.

7. The electron beam accelerator system of claim 5, further comprising a location magnet located between the control grid and the anode structure, wherein the electron sensing structure provides a signal representing a location bias of the electron beam for adjusting operation of the location magnet.

8. An electron beam accelerator system comprising:

a variable voltage source;

a pulse forming network coupled to the variable voltage source;

a high power switching device coupled between the variable voltage source and the pulse forming network;

a pulse control circuit connected to control the high power switching device to selectively allow a current to flow to the pulse forming network;

a step-up transformer coupled to the pulse forming network, the step-up transformer having a high voltage output;

a cathode structure coupled to the high voltage output of the step-up transformer, an anode structure spaced from the cathode structure, the anode structure having a first voltage associated therewith such that a voltage difference exists between the cathode structure and the anode structure, the voltage difference creating an electron beam with an energy level based on the variable voltage source flowing between the cathode structure and the anode structure;

an electron beam output adjacent to the anode structure.

a control grid between the cathode structure and the anode structure; and a control grid drive circuit operatively coupled to the pulse control circuit and the control grid, the control grid drive circuit applying a time-varying second voltage to the control grid synchronized with the pulse control circuit.

9. The electron beam accelerator system of claim 8, further comprising:

a focusing magnet between the anode structure and the control grid.

10. The electron beam accelerator system of claim 9, further comprising:

an electron sensing structure adjacent to the electron beam to provide a signal representing a focus characteristic of the electron beam for adjusting operation of the focusing magnet.

11. The electron beam accelerator system of claim 8, further comprising:

an external controller coupled to control the variable voltage source.

12. The electron beam accelerator of claim 10, wherein the step-up transformer, the cathode structure, the anode structure, the control grid, the focusing magnet and the electron sensing structure are housed in a vessel containing dielectric oil.

13. The electron beam accelerator system of claim 12, wherein the cathode structure, the anode structure, the control grid, the focusing magnet and the electron sensing structure are housed in a ceramic envelope within the vessel containing dielectric oil.

14. The electron beam accelerator system of claim 8, wherein the pulse-forming network comprises a plurality of inductors connected in series and a plurality of capacitors connected in parallel between the variable voltage source and the step-up transformer.

15. An electron beam accelerator system comprising:

a high voltage variable supply circuit having a variable high voltage output;

a cathode structure coupled to the high voltage variable supply circuit at the variable high voltage output;

an anode structure spaced from the cathode structure, the anode structure having a voltage associated therewith such that a voltage difference exists between the cathode structure and the anode structure, the voltage difference creating an electron beam with an energy level based on the variable high voltage output of the high voltage variable supply circuit flowing between the cathode structure and the anode structure, the electron beam output being adjacent to the anode structure; and a control grid between the cathode structure and the anode structure wherein the control grid receives a time-varying voltage to prevent ringing of the high voltage output.

16. The electron beam accelerator system of claim 15, further comprising:

at least one focusing magnet between the control grid and the anode structure and adjacent to the electron beam.

17. The electron beam accelerator system of claim 16, further comprising:

an electron sensing structure located adjacent to the electron beam to provide a signal representing a focus characteristic of the electron beam for adjusting operation of the at least one focusing magnet.

18. The electron beam accelerator system of claim 17, wherein the electron sensing structure is a sugar scoop sensor.

19. The electron beam accelerator system of claim 17, further comprising a location magnet located between the control grid and the anode structure, wherein the electron sensing structure provides a signal representing a location bias of the electron beam for adjusting operation of the location magnet.

20. The electron beam accelerator system of claim 16, further comprising:

an embedded computer operable to control a field strength of the at least one focusing magnet.

21. The electron beam accelerator system of claim 20, wherein the embedded computer is coupled to control the high voltage variable supply circuit.

22. The electron beam accelerator system of claim 15, further comprising:

an external controller coupled to control the high voltage variable supply circuit.

* * * * *

UNITED STATES PATENT AND TRADEMARK OFFICE

CERTIFICATE OF CORRECTION

PATENT NO. : 6,781,330 B1
DATED : August 24, 2004
INVENTOR(S) : Steven E. Koenck et al.

It is certified that error appears in the above-identified patent and that said Letters Patent is hereby corrected as shown below:

Column 1,
Line 15, delete “application Ser.”, insert -- Application --

Column 3,
Line 31, delete “LA”, insert -- L4 --

Signed and Sealed this

Nineteenth Day of April, 2005

JON W. DUDAS
*Director of the United States Patent and Trademark Office*